US009453375B2

(12) United States Patent
Hoefler

(10) Patent No.: US 9,453,375 B2
(45) Date of Patent: Sep. 27, 2016

(54) RISER WITH SLIM PIN AUXILIARY LINE

(71) Applicant: Cameron International Corporation, Houston, TX (US)

(72) Inventor: John Hoefler, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/132,805

(22) Filed: Dec. 18, 2013

(65) Prior Publication Data

US 2015/0167398 A1 Jun. 18, 2015

(51) Int. Cl.
*E21B 17/01* (2006.01)
*E21B 17/08* (2006.01)

(52) U.S. Cl.
CPC ..... *E21B 17/085* (2013.01)

(58) Field of Classification Search
CPC ..... E21B 17/01; E21B 17/085
USPC ..... 166/367
See application file for complete search history.

(56) References Cited

U.S. PATENT DOCUMENTS

| | | | | |
|---|---|---|---|---|
| 4,043,575 | A * | 8/1977 | Roth | 285/90 |
| 4,097,069 | A * | 6/1978 | Morrill | 285/84 |
| 4,496,173 | A * | 1/1985 | Roche et al. | 285/24 |
| 6,536,480 | B2 * | 3/2003 | Guesnon et al. | 138/172 |
| 6,623,044 | B1 * | 9/2003 | Guesnon et al. | 285/124.1 |
| 8,733,452 | B2 * | 5/2014 | Guesnon et al. | 166/378 |
| 9,222,315 | B2 * | 12/2015 | Chen | E21B 17/085 |
| 2010/0319925 | A1 * | 12/2010 | Papon et al. | 166/345 |
| 2011/0037257 | A1 | 2/2011 | Walker | |
| 2012/0312544 | A1 * | 12/2012 | Tavner et al. | 166/367 |
| 2013/0043036 | A1 | 2/2013 | Kotrla et al. | |
| 2013/0192706 | A1 * | 8/2013 | Poirette et al. | 138/109 |

* cited by examiner

*Primary Examiner* — Matthew R Buck
(74) *Attorney, Agent, or Firm* — Chamberlain Hrdlicka

(57) ABSTRACT

A subsea riser system includes a riser joint. The riser joint includes a main line and an auxiliary line, in which the auxiliary line includes a pin section, a box section, and an interior section intermediate the pin section and the box section. An internal diameter of the interior section is larger than an internal diameter of the pin section.

18 Claims, 6 Drawing Sheets

RISER WITH SLIM PIN AUXILIARY LINE

BACKGROUND

As will be appreciated, oil and natural gas have a profound effect on modern economies and societies. For instance, oil and natural gas are used for fuel in a wide variety of vehicles, such as cars, airplanes, boats, and the like, in addition to manufacturing an astonishing array of everyday products. In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource.

In offshore operations, oil platforms typically support risers that extend from one or more wellheads or structures on the seabed to the platform on the sea surface. Such systems generally include a wellhead assembly to extract resources through, in which these wellhead assemblies include a wide variety of components, such as various casings, valves, fluid conduits, and the like, to control drilling and/or extraction operations. The risers connect the subsea well with the platform to protect the fluid integrity of the well and to provide a fluid conduit to and from the wellbore. During drilling operations, a drilling riser is used to maintain fluid integrity of the well. After drilling is completed, a production riser may be installed.

For example, in a subsea well, a riser made of up riser sections may extend from the seafloor up to a rig on the surface of the sea. A typical riser section may include a flanged assembly formed from steel on each end, and the riser may perform multiple functions. In addition to transporting drilling fluid into the well, the riser may provide pipes to allow drilling fluids, mud, and cuttings to flow up from the well. Further, once production begins, a riser may be used to transport production fluids from the well to the rig or other location for storage or refinement.

As subsea wells are placed in deeper subsea locations (e.g., 10,000 to 12,000 ft.), conventional risers may become difficult to install and operate. Because of the tension and pressure load at such depths, typical riser joints are designed to be heavier to withstand this increased tension and pressure. However, such heavier risers may exceed the derrick capacity or the deck load of the rig supporting the riser. For example, increasing the pressure capacity of the riser joints within a riser system may increase the weight of the riser system by about 1,000,000 lbs (about 453,600 kg) or more. Additionally, longer risers may require increased tension to ensure stability and rigidity of the riser. As such, reducing the weight of risers and accompanying equipment remains a priority to increase the efficiency and safety and reduce the cost of subsea equipment.

BRIEF DESCRIPTION OF THE DRAWINGS

For a detailed description of the preferred embodiments of the invention, reference will now be made to the accompanying drawings in which.

DETAILED DESCRIPTION

Figure 1:
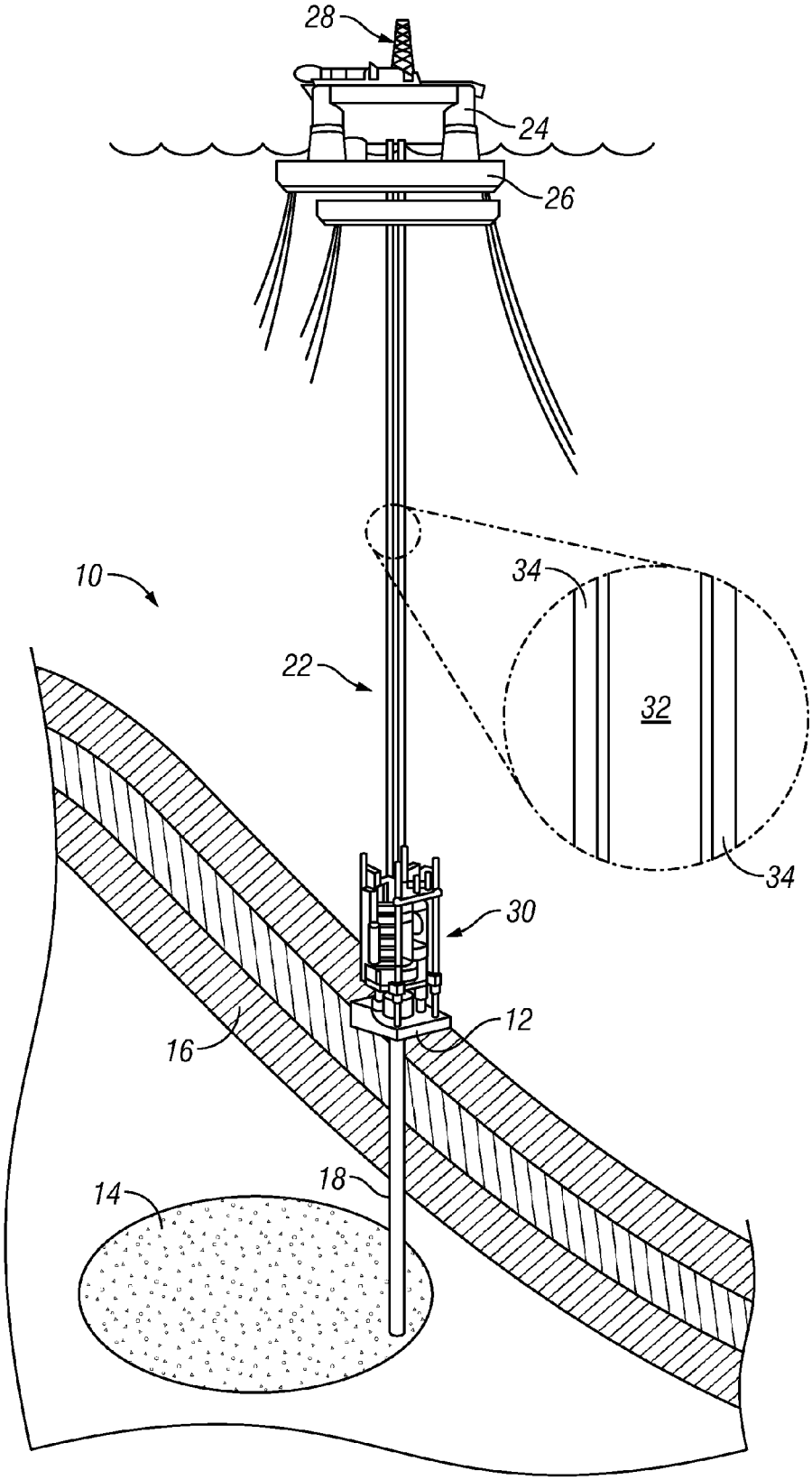
FIG. 1 show a subsea mineral extraction system in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Accordingly, disclosed herein is a riser system for a mineral extraction system, in which the riser system may include one or more riser joints connected to each other. The riser joint may include a main line and an auxiliary line. The auxiliary line may include a pin section, a box section, and an interior section intermediate the pin section and the box section. An internal diameter of the interior section may be larger than an internal diameter of the pin section, and an external diameter of the interior section may be larger than an external diameter of the pin section. Further, the main line of the riser joint may include a flange at an end thereof, in which the flange may include an auxiliary opening formed therethrough such that the pin section and/or the box section of the auxiliary line may be removably received within the auxiliary opening.

Referring now to FIG. 1, a subsea mineral extraction system 10 in accordance with one or more embodiments of the present disclosure is shown. The illustrated mineral extraction system 10 may be configured to facilitate extracting various minerals and natural resources for the earth, including hydrocarbons (e.g., oil and/or natural gas), or configured to inject substances into the earth. Accordingly, the present disclosure may be used within any oil and gas environment, such as within a subsea environment, a drilling system, and/or a production system. As such, in one or more embodiments, as illustrated, the system 10 may include a wellhead assembly 12 coupled to a mineral deposit 14 using a well 16, in which the well 16 may include a well-bore 18.

The wellhead assembly 12 may include one or more components to control and regulate activities and conditions associated with the well 16. For example, the wellhead assembly 12 may include one or more bodies, valves, and/or seals that route produced minerals from the mineral deposit 14, provide for regulating pressure in the well 16, and/or provide for the injection of chemicals into the well-bore 18 (down-hole).

In the illustrated embodiment, the wellhead 12 may include a tubing spool, a casing spool, and/or a hanger (e.g., a tubing hanger or a casing hanger). Further, the system 10 may include other devices that are coupled to the wellhead 12, such as a blowout preventer (BOP) stack 30 and/or other devices, that are used to assemble and control various components of the wellhead 12. For example, the wellhead assembly 12 may include the BOP stack, which may include one or more BOPs, a variety of valves, fittings, and controls to block oil, gas, or other fluid from exiting the well 16 in the event of an unintentional release of pressure or an overpressure condition.

A riser system 22 may extend from the BOP stack 30 to a rig 24, such as a platform or floating vessel 26. The rig 24 may be positioned above the well 16, in which the rig 24 may include one or more components suitable for operation of the mineral extraction system 10, such as pumps, tanks, power equipment, and/or any other components. The rig 24 may include a derrick 28 to support the riser system 22, a tension control mechanism, and/or any other components.

In addition to other operations, the riser system 22 may carry drilling fluid (e.g., "mud") between the rig 24 to the well 16, may carry the drilling fluid ("returns"), cuttings, or any other substance, between the well 16 to the rig 24, and/or may various minerals and natural resources, including hydrocarbons (e.g., oil and/or natural gas), between the well 16 to the rig 24. In one or more embodiments, the riser system 22 may include a main line 32 having a larger diameter and one or more auxiliary lines 34 having a smaller diameter, as described further below. The main line 32 may be connected centrally over the bore (such as coaxially) of the well 16, and may provide a passage from the rig to the well. The auxiliary lines 34 may include choke lines, kill lines, hydraulic lines, glycol injection, mud return, mud boost lines, and/or any other suitable type of fluid line. For example, some of the auxiliary lines 34 may be coupled to the BOP stack 30 to provide choke and kill functions to the BOP stack 30.

As described further below, the riser system 22 may be formed from numerous "joints" of pipe, coupled together, such as through flanges, breech locks, or any other couplers known in the art. Additionally, the riser system 22 may include flotation devices, clamps, or other devices distributed along the length of the riser system 22.

Figure 2A:
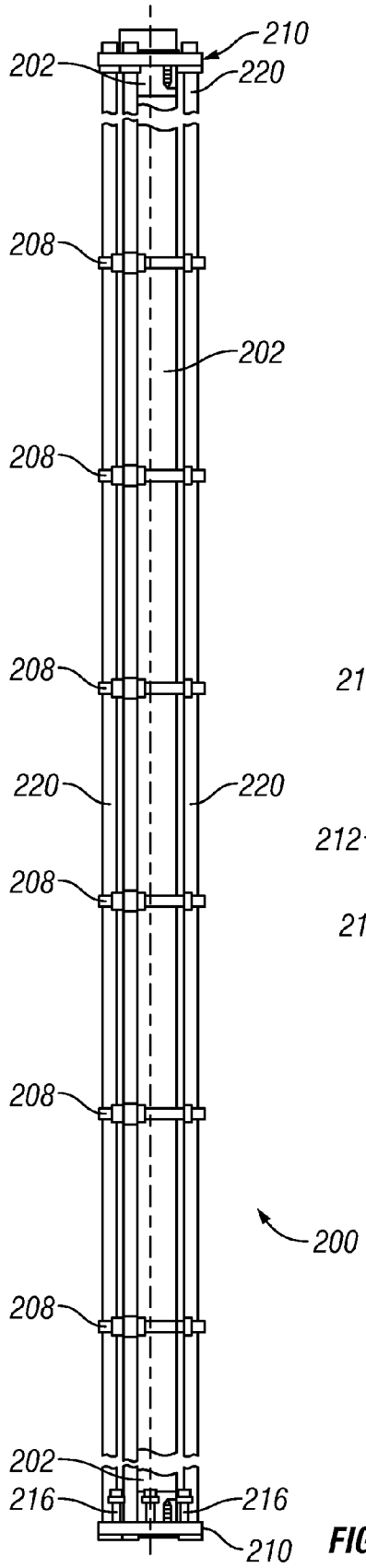
FIG. 2A shows a riser joint of a riser system in accordance with one or more embodiments of the present disclosure.
Figure 2B:
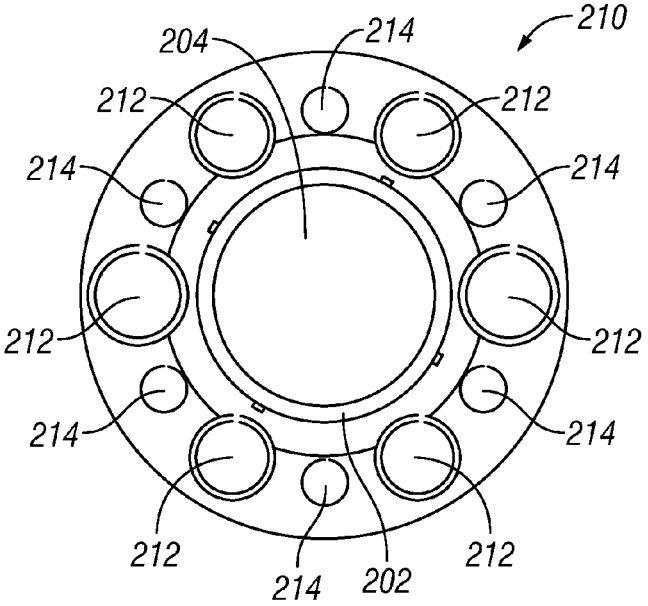
FIG. 2B shows a riser joint of a riser system in accordance with one or more embodiments of the present disclosure.

Referring now to FIGS. 2A and 2B, a side view and a top view, respectively, of a riser joint 200 of the riser system 22 in accordance with one or more embodiments of the present disclosure are shown. The riser joint 200 may include one or more couplers, such as flanges 210 in this embodiment, to couple the joint 200 to other joints and make-up the riser system 22. In this manner, a riser system 22 may be constructed to any desired length using a specific number of joints 200. Thus, when assembling a plurality of riser joints 200 together to form the riser system 22, the auxiliary lines 220 may be joined to form a continuous line along the length of the riser system 22. The flanges 210 may include a plurality of bolts 216 to enable coupling to a flange of another joint of the riser system 22. In such an embodiment, the bolts 216 may be threadably secured to a nut, for example, when coupling the flanges 210 to each other.

As shown in the FIG. 2A, the riser joint 200 may include a main line 202 and one or more auxiliary lines 220 surrounding the main line 202. In some embodiments, the main line 202 of the riser joint 200 may be a relatively larger diameter than the auxiliary lines 220. The riser joint 200 may also include one or more clamps 208 located axially at intervals along the length of the riser joint 200. The clamps 208 may secure and stabilize the auxiliary lines 220 and/or the main line 202. As described above, during operation of the mineral extraction system 10, tools, drilling fluids (e.g., mud), or any other substance or device may be provided down the main line 202.

As shown in FIG. 2B, in an embodiment in which flanges are used as couplers to couple one or more riser joints 200 to each other, the flange 210 may include a central bore 204 and may couple to the main line 202 (e.g., welding the flange 210 and main line 202). The flange 210 may include a seal sub to seal the flange 210 against an adjacent flange. Additionally, the flange 210 may include a plurality of openings 214 (e.g., threaded receptacles) configured to receive the plurality of bolts 216. To provide for assembly of the auxiliary lines 220, the flange 210 may include one or more openings 212 to allow for passage of the auxiliary lines 220 through the flange 210. For example, the flange 210 may include the openings 212 for a choke line, a kill line, a mud boost line, a hydraulic line, etc. In some embodiments, the openings 212 may be of the same diameter or different diameters.

Figure 3:
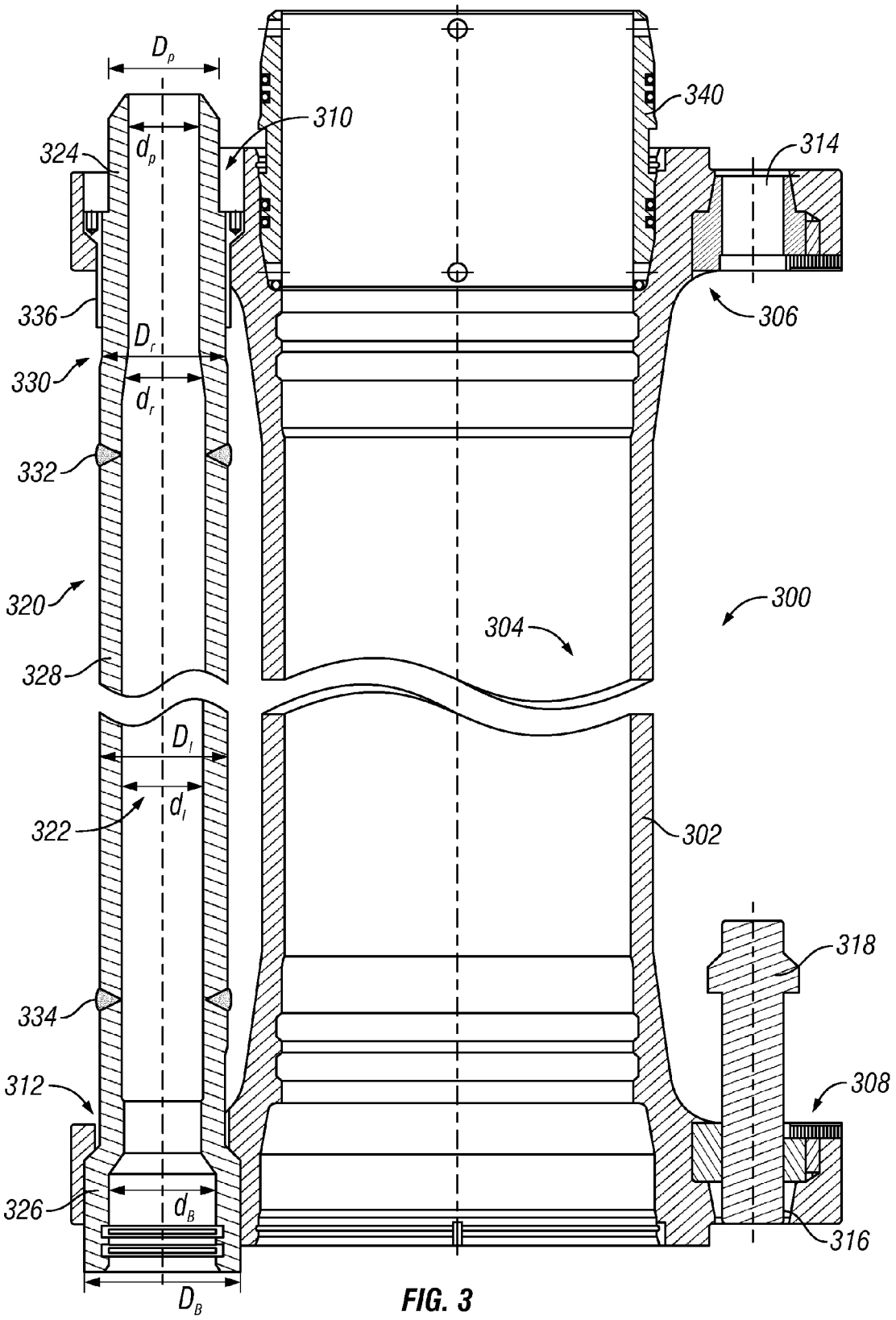
FIG. 3 shows a riser joint in accordance with one or more embodiments of the present disclosure.

Referring now to FIG. 3, a riser joint 300 in accordance with one or more embodiments of the present disclosure is shown. As with above, the riser joint 300 may include a main line 302 and one or more auxiliary lines 320. The main line 302 may include a central bore 304 formed therethrough and may be used to transport fluids, such as production fluids and/or drilling fluids, between a well and a rig or other location. Further, the auxiliary line 320 may include a central bore 322 formed therethrough and may be used to transport fluid, such as pressurized gas and/or liquid, between a rig and components used with a well, such as a BOP stack.

The auxiliary line 320 may include and/or be formed as multiple sections, in which the auxiliary line 320 may include a pin section 324, a box section 326, and an interior section 328 intermediate the pin section 324 and the box section 326. The auxiliary line 320 may be formed to include multiple different inner diameters and outer diameters such that one or more of the sections of the auxiliary line 320 varies in inner diameter and/or outer diameter with respect to other sections of the auxiliary line 320.

Accordingly, the pin section 324 may include an internal diameter $d_P$ and an external diameter $D_P$, thereby defining a wall thickness for the pin section 324. The box section 326 may include an internal diameter $d_B$ and an external diameter $D_B$, thereby defining a wall thickness for the box section 326. Likewise, the interior section 328 may include an internal diameter $d_I$ and an external diameter $D_I$, thereby defining a wall thickness for the interior section 328. As such, in accordance with one or more embodiments of the present disclosure, the internal diameter $d_I$ of the interior section 328 may be larger than the internal diameter $d_P$ of the pin section 324, and the internal diameter $d_B$ of the box section 326 may be larger than the internal diameter $d_I$ of the interior section 328. Further, the external diameter $D_I$ of the interior section 328 may be larger than the external diameter $D_P$ of the pin section 324, and the external diameter $D_B$ of the box section 326 may be larger than the external diameter $D_I$ of the interior section 328.

In addition to the pin section 324, the box section 326, and/or the interior section 328, the auxiliary line 320 may further include one or more tapered sections, in which an internal diameter and/or an external diameter of a tapered section may be tapered with respect to other sections of the auxiliary line 320. For example, with reference to FIG. 3, the auxiliary line 320 may include a tapered section 330, in which the tapered section 330 may be intermediate the pin section 324 and the interior section 328.

As such, the tapered section 330 may include an internal diameter $d_T$ and an external diameter $D_T$. The internal diameter $d_T$ of the tapered section 330 may be tapered intermediate the internal diameter $d_P$ of the pin section 324 and the internal diameter $d_I$ of the interior section 328, and the external diameter $D_T$ of the tapered section 330 may be tapered intermediate the external diameter $D_P$ of the pin section 324 and the external diameter $D_I$ of the interior section 328. In particular, the internal diameter $d_T$ of the tapered section 330 may be tapered between and extend from the internal diameter $d_P$ of the pin section 324 and the internal diameter $d_I$ of the interior section 328, and the external diameter $D_T$ of the tapered section 330 may be tapered between and extend from the external diameter $D_P$ of the pin section 324 and the external diameter $D_I$ of the interior section 328.

As the auxiliary line 320 may include one or more sections, such as the pin section 324, the box section 326, the interior section 328, and/or the tapered section 330, the auxiliary line 320 may be formed as a monolithic structure, and/or one or more of the sections may be connected to each other to form the auxiliary line 320. For example, as shown in FIG. 3, the interior section 328 may be connected to the tapered section 330 using a connection 332, and/or the interior section 328 may be connected to the box section 326 using a connection 334. The connection 332 and/or the connection 334 may be a weld connection, as shown. However, those having ordinary skill in the art will appreciate that any type of connection, such as a threaded connection, an interference connection, and/or any other connection known in the art, may be used without departing from the scope of the present disclosure. Further, though the connection 332 and the connection 334 are shown, additional or alternative connections may be included within the auxiliary line 320 without departing from the scope of the present disclosure.

Referring still to FIG. 3, the main line 302 of the riser joint 300 may include one or more couplers to couple adjacent riser joints 300 to each other. As such, in this embodiment, flanges may be used as couplers, such as a flange 306 at one end, such as a lower end, of the main line 302, and a flange 308 at another, such as an upper end, of the main line 302. The flange 306 and/or the flange 308 may be integrally formed with the main line 302, as shown, and/or the flange 306 and/or the flange 308 may be connected to the main line 302 using a connection, such as a weld connection, threaded connection, and/or any other connection type known in the art.

Accordingly, the flanges may include one or more auxiliary openings formed therethrough, such as to receive the one or more auxiliary lines within the flanges. For example, as shown in FIG. 3, the flange 306 may include an auxiliary opening 310 formed therethrough, in which the pin section 324 of the auxiliary line 320 may be removably received within the auxiliary opening 310. Further, the flange 308 may include an auxiliary opening 312 formed therethrough, in which the box section 326 of the auxiliary line 320 may be removably received within the auxiliary opening 312.

Further, in addition to the auxiliary openings, the flanges may additionally include one or more other openings. For example, with reference to FIG. 3, the flange 306 may include an opening 314, and the flange 308 may include an opening 316. The opening 314 and the opening 316 may be used and configured to receive one or more bolts 318, such as by having the opening 314 and/or the opening 316 formed as threaded receptacles and/or included threaded nuts to engage the bolts 318. The bolts 318 may be used to facilitate connecting the riser joint 300 to adjacent riser joints and/or to adjacent structures, such as a rig, wellhead assembly, and/or BOP stack.

As the riser joint 300 of a riser system may be under tension and/or compression, such as when using within a mineral extraction system, the main line 302 and/or the auxiliary line 320 may experience lengthening and/or shortening due to the tension and/or compression. As such, the riser joint 300 may further include one or more adjustment sleeves, such as an adjustment sleeve 336 adjacent the auxiliary line 320. In particular, the adjustment sleeve 336 may be intermediate the opening 310 of the flange 306 and the pin section 324 of the auxiliary line 320. The adjustment sleeve 336 may be connected to the pin section 324, such as through a threaded connection, and/or may be connected to the flange 306, such as by having the adjustment sleeve 336 positioned between the pin section 324 of the auxiliary line 320 and connected to the pin section 324. Accordingly, the adjustment sleeve 336 may be adjusted, such as rotated with respect to the auxiliary line 320, to selectively lengthen or shorten the length or distance of the auxiliary line 320 between the flange 306 and the flange 308.

In addition, or in alternative to an adjustment sleeve, a riser joint in accordance with the present disclosure may include a collar. For example, a collar may be attached to and/or formed on an auxiliary line in accordance with the present disclosure, in which the collar may be used to secure and position the auxiliary line with respect to the main line of the riser joint. An example of a collar may be a shoulder formed on the auxiliary line and/or a retainer position on the auxiliary line, such as a snap ring secured about the auxiliary line to form and/or function as a collar.

Referring still to FIG. 3, the riser joint 300 may include one or more seal subs to facilitate connecting the riser joint 300 to adjacent riser joints and/or to adjacent structures, such as a rig, wellhead assembly, and/or BOP stack. For example, the riser joint 300 may include a seal sub 340, in which the seal sub 340 may be used to facilitate connecting the riser joint 300 at an end, such as the end of the riser joint 300, to an end of an adjacent riser joint, such as the end of an adjacent riser joint. The seal sub 340 may be a male-to-male sub, as shown, and/or may have other configurations, such as a male-to-female sub or a female-to-female sub.

As shown and discussed above, an auxiliary line in accordance with one or more embodiments of the present disclosure may include sections of different diameters and may include one or more tapered sections. By varying the diameter of the auxiliary line, such as by varying the inner diameter and/or the outer diameter of the auxiliary line, the auxiliary line may be able to facilitate increased flow rates and/or pressures therethrough. For example, as shown in FIG. 3, the internal diameter $d_I$ and external diameter $D_I$ of the interior section 328 may be larger than the internal diameter $d_P$ and the external diameter $D_P$ of the pin section 324. By increasing one or both of these diameters, a larger flowpath and/or increased pressure capacity may be included and used for the auxiliary line 320, such as compared to an auxiliary line having a single diameter internal diameter and/or external diameter.

In particular, an auxiliary line in accordance with the present disclosure may have an increased internal diameter and external diameter for an interior section of the auxiliary line, while an internal diameter and external diameter for a pin section and/or box section may be sized to still be received within an auxiliary opening of a flange of a riser joint. As such, an auxiliary line in accordance with the present disclosure may be capable of handling an increased pressure capacity, such as due to increased wall thickness, and still be sized to be used with standard joints and fittings, such as typically used within a riser system in the oil and gas industry, while minimizing frictional pressure loss for flow through the auxiliary line.

By way of example only, as may be standard for a riser joint used within the oil and gas industry, the main line 302 may include an internal diameter of about 19.25 in (about 48.9 cm) and may include an external diameter between about 21 in (about 53.3 cm) and about 21.25 in (about 54.0 cm), and therefore may have a wall thickness between about 0.875 in (about 2.22 cm) and 1 in (about 2.54 cm).

As such, for the auxiliary line 320 used with the main line 302, the internal diameter $d_P$ of the pin section 324 may be about 3.68 in (about 9.35 cm) and the external diameter $D_P$ of the pin section 324 may be about 5.65 in (about 14.35 cm), and therefore the pin section 324 may have a wall thickness of about 0.985 in (about 2.51 cm). The internal diameter $d_I$ of the interior section 328 may be about 4.5 in (about 11.4 cm) and the external diameter $D_I$ of the interior section 328 may be about 7.25 in (about 18.4 cm), and therefore the interior section 328 may have a wall thickness of about 1.375 in (about 3.5 cm). Further, the internal diameter $d_B$ of the box section 326 may be about 5.655 in (about 14.36 cm) and the external diameter $D_B$ of the box section 326 may be about 8.70 in (about 22.1 cm), and therefore the box section 326 may have a wall thickness of about 1.5225 in (about 3.867 cm). As such, in one or more embodiments of the present disclosure, a ratio of the internal diameter of the interior section with respect to the internal diameter of the pin section may be between about 1.1:1 and 1.3:1, and a ratio of the external diameter of the interior section with respect to the external diameter of the pin section may be between about 1.15:1 and 1.35:1.

Accordingly, as discussed above, the auxiliary line 320 may be formed to include multiple different inner diameters and outer diameters such that one or more of the sections of the auxiliary line 320 varies in inner diameter and/or outer diameter with respect to other sections of the auxiliary line 320. Further, the auxiliary line 320 may reduce pressure loss for fluid flow therethrough when incorporating the use of multiple different inner diameters while increasing pressure capacity of the auxiliary line 320, such as due to an increased wall thickness. For example, using the dimensions discussed above, the auxiliary line 320 shown in FIG. 3 may be capable of having a pressure capacity of about 20,000 psi (about 137.9 MPa), whereas an auxiliary line including only a single diameter may only be capable of having a pressure capacity of about 15,000 psi (about 103.4 MPa).

Accordingly, frictional pressure loss for a pipe may be calculated using the following equation, where $P_{ds}$=frictional pressure loss, $\rho_P$=fluid density, $V_p^2$=fluid velocity, f=Fanning friction factor, L=pipe length, and $d_i$=pipe internal diameter:

$$P_{ds} = \sum \frac{1.076 * \rho_p * V_p^2 * f * L}{10^5 * d_i} \qquad \text{Equation (1)}$$

Fluid velocity, $V_p^2$, may be calculated using the following equation, where Q=flow rate:

$$V_p = \frac{24.51 * Q}{d_i^2} \qquad \text{Equation (2)}$$

The Fanning friction factor, f, may be calculated using the following equation, where Re=Reynolds number, a & b=empirically derived constants, which for laminar flow a=16 & b=1, μ=dynamic viscosity:

$$f = \frac{a}{Re^b} = \frac{a}{\left(\frac{\rho_p * V_p * d_i}{\mu}\right)^b} \qquad \text{Equation (3)}$$

After substituting Equations (2) and (3) into Equation (1), simplifying, treating the flow rate, Q, as constant due to Conservation of Mass, treating fluid density, $\rho_p$, and dynamic viscosity, μ, as constant over the length of a riser joint and riser system, and assuming the empirically derived constant, b, is zero for maximum effect, frictional pressure loss may be calculated using the following equation:

$$P_{ds} = \sum \frac{1.076 * a * 24.51^{2-b} * \rho_p^{1-b} * Q^{2-b} * \mu^b}{10^5} * \frac{L}{d_i^{5-b}} = f\left(\frac{L}{d_i^{5-b}}\right) \qquad \text{Equation (4)}$$

Accordingly, for a riser joint and/or a riser system using a single diameter and/or a straight bore, frictional pressure loss may be approximated using the following equation, where D=internal diameter of the pipe:

$$\Delta P_{str} = f\left(\frac{L}{D^5}\right) \qquad \text{Equation (5)}$$

Figure 4:
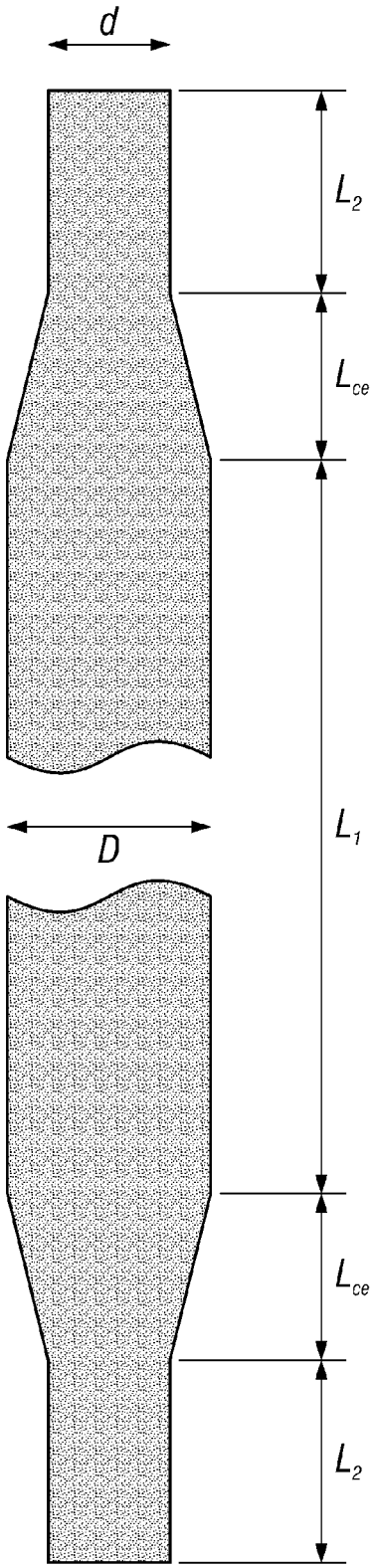
FIG. 4 shows a riser joint in accordance with one or more embodiments of the present disclosure.

For a riser joint and/or a riser system using multiple different inner diameters and outer diameters, frictional pressure loss for the auxiliary line may be approximated using the following equation, where d=internal diameter of the pin section, D=internal diameter of the interior section, $L_1$=length of the interior section, $L_2$=length of the pin section and/or box section, and $L_{ce}$=length of one or more tapered sections included intermediate the interior section and the pin section and/or intermediate the interior section and the box section, each reference shown in FIG. 4:

$$L = L_1 + 2*(L_2 + L_{ce}) \quad \text{Equation (6)}$$

$$\Delta P_{var} = f\left(\frac{L_1}{D^5} + \frac{2*(L_2 + L_{ce})}{d^5}\right) \quad \text{Equation (7)}$$

Accordingly, substituting the dimensions discussed above, by way of example only, where L=about 75 ft (about 22.9 m), D=about 4.5 in (about 11.43 cm), d=about 3.68 in (about 9.35 cm), and $L_2$ and $L_{ce}$=about 1.5% of the overall length of the pipe, a ratio of the pressure loss for a pipe having a straight bore and single diameter $\Delta P_{str}$ to pressure loss for a pipe having a variable diameter $\Delta P_{var}$ may be calculated using the following equation:

$$\Delta P_{var} = f\left(\frac{0.97L}{D^5} + \frac{0.03L}{d^5}\right) \quad \text{Equation (8)}$$

$$\frac{\Delta P_{var}}{\Delta P_{str}} = \frac{0.513}{0.488} = 1.051 \quad \text{Equation (9)}$$

Figure 5:
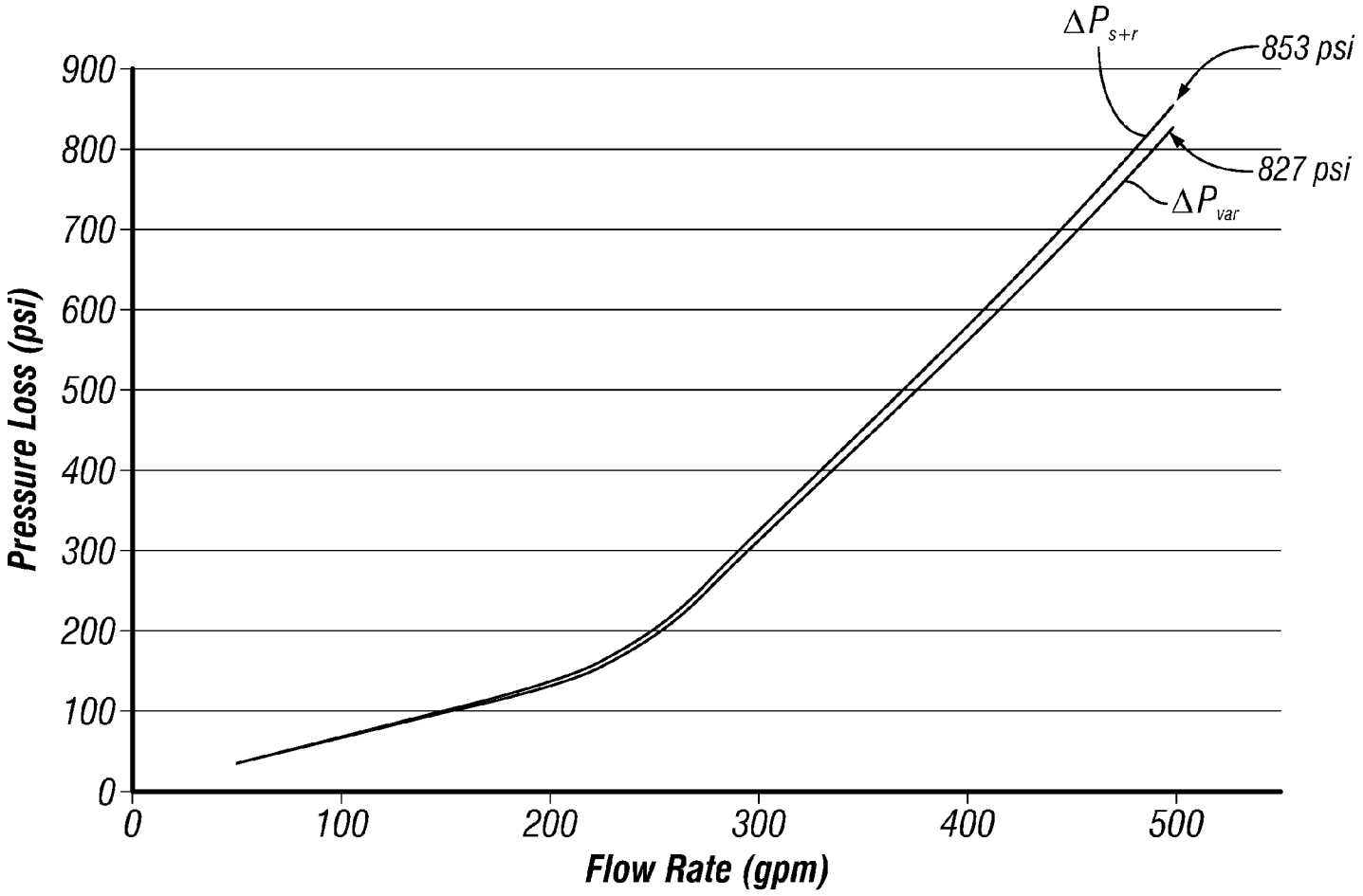
FIG. 5 shows a graphical representation of pressure loss versus flow rate of the comparison of a pipe having a variable diameter versus a pipe having a straight bore or single diameter in accordance with one or more embodiments of the present disclosure.

Therefore, with the calculations and assumptions above and substituting dimensions shown above, the frictional pressure loss for a pipe having a variable diameter $\Delta P_{var}$, such as the auxiliary line 320 shown in FIG. 3, may be calculated at about 5% higher than a pipe having a straight bore or single diameter $\Delta P_{str}$. In other embodiments, this frictional pressure loss ratio may be about 3.1% or lower. However, as discussed above, a pipe having a variable diameter $\Delta P_{var}$, such as the auxiliary line 320 shown in FIG. 3, may have increased pressure capacity, such as about 20,000 psi (about 137.9 MPa) or more, depending on the dimensions of the auxiliary line, whereas an auxiliary line including only a single diameter may only be capable of having a pressure capacity of about 15,000 psi (about 103.4 MPa). Accordingly, FIG. 5 shows a graphical representation of pressure loss versus flow rate of the comparison of a pipe having a variable diameter $\Delta P_{var}$ versus a pipe having a straight bore or single diameter $\Delta P_{str}$.

Figure 6:
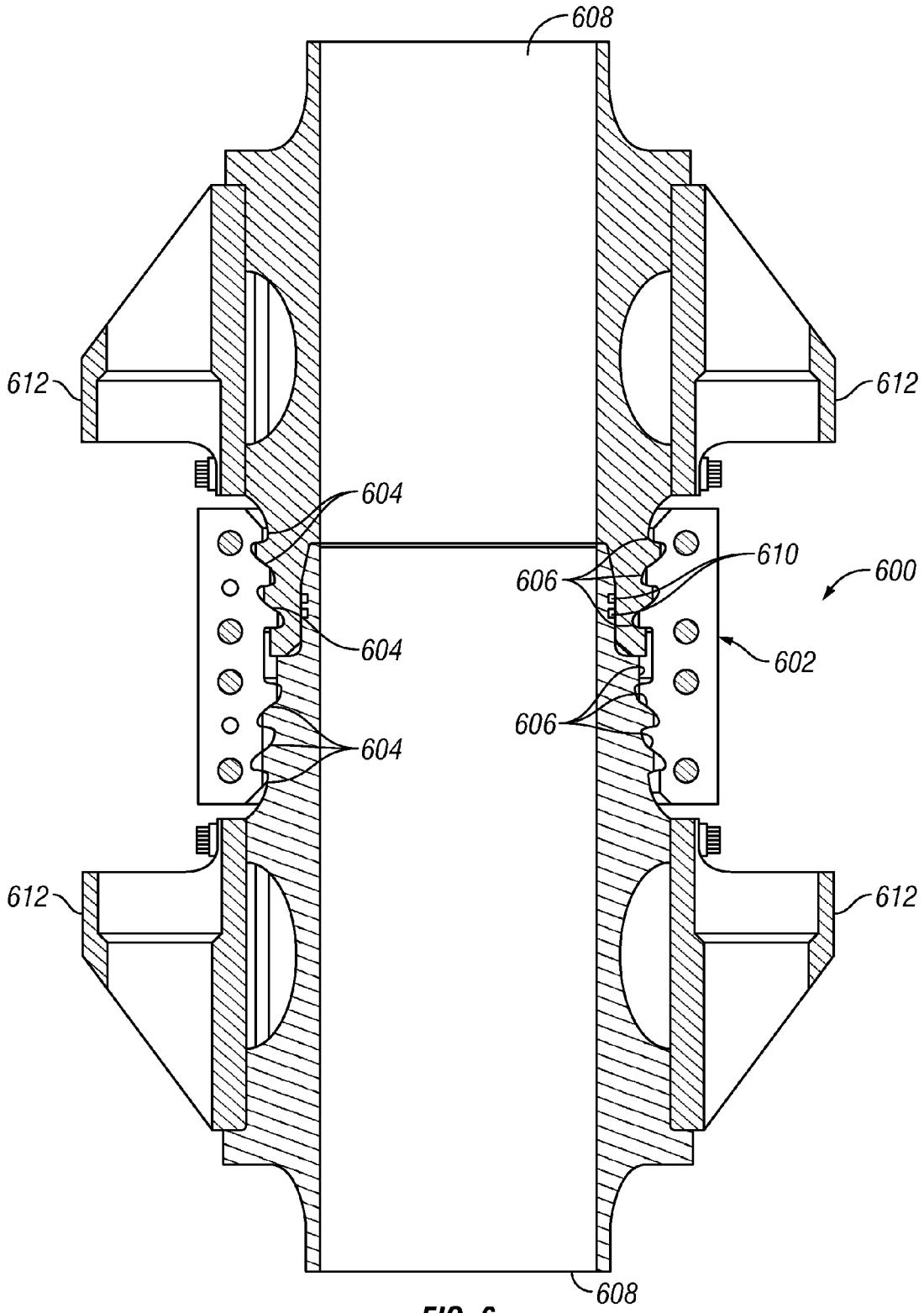
FIG. 6 shows a riser joint in accordance with one or more embodiments of the present disclosure.

As discussed above, a riser joint and an auxiliary line in accordance with the present disclosure may include one or couplers, such as a flange as discussed and described above, to couple multiple riser joints and auxiliary lines to each other within a riser system. However, the present disclosure is not so limited. For example, as shown in FIG. 6, a coupler in accordance with one or more embodiments of the present disclosure may include a breech lock coupler 600, such as described within U.S. application Ser. No. 12/933,861, which is assigned to the assignee of the present disclosure, and is incorporated by reference herein in its entirety. The breech lock coupler 600 may include a locking ring 602, in which the locking ring 602 may include a plurality of teeth 604 formed on an inner surface thereof, in which the teeth 604 may be used to engage corresponding teeth 606 formed on main lines 608. For example, in this embodiment, an end of one of the main lines 608 may include a pin member that is received within a box member of an end of the other of the main lines 608. One or more seals 610 may be positioned between the ends of the main lines 608. The locking ring 602 may then be positioned adjacent the ends of the main lines 608 to have the teeth 604 of the locking ring 602 engage and mate with the corresponding teeth 606 of the main lines 608, thereby coupling the main lines 608 to each other. Further, one or more external tube supports 612 may be positioned adjacent the ends of the main lines 608. The external tube supports 612 may include an auxiliary opening formed therethrough, such as to receive and accommodate an auxiliary line, in accordance with one or more embodiments of the present disclosure. As such, the present disclosure may be used with the breech lock coupler 600, as an auxiliary line of the present disclosure may be received within the external tube supports 612. Accordingly, the present disclosure contemplates other embodiments for couplers, besides only flanges and breech lock couplers, to couple adjacent riser joints to each other that include auxiliary lines in accordance with the present disclosure.

Accordingly, a riser joint and/or a riser system in accordance with the present disclosure may include auxiliary lines with an increased pressure capacity, such as from an increased wall thickness, yet still be used with a standard size riser joint and coupler. An auxiliary line in accordance with the present disclosure may be used to replace one or more existing auxiliary lines, as an auxiliary line in accordance with the present disclosure may be sized for use with a standard riser joint used within the oil and gas industry. For example, an existing auxiliary line having a pressure capacity of about 15,000 psi (about 103.4 MPa), which may be common for a riser joint having a main line with an internal diameter of about 19.25 in (about 48.9 cm), may be replaced with an auxiliary line of the present disclosure having a pressure capacity of about 20,000 psi (about 137.9 MPa), as the auxiliary line of the present disclosure may be sized at the pin section and the box section to be removably received within the auxiliary openings of the flange of the riser joint. Similarly, riser joints including larger or smaller pressure capacities with larger or smaller internal diameters may similarly be modified, such as to increase the pressure capacity of such auxiliary lines, without departing from the scope of the present disclosure.

One or more embodiments of the present disclosure may be used to reduce costs and overall weight within a mineral extraction system, such as by replacing the auxiliary lines of a riser joint and a riser system. For example, instead of having to replace an entire riser system to increase the pressure capacity of the auxiliary lines, only the auxiliary lines may be replaced, as discussed above, to increase the pressure capacity. Further, by only replacing the auxiliary lines, as compared to replacing the riser joints within a riser system, the weight of each riser joint may be reduced as the main line of the riser joint may have a reduced weight, as compared to the riser joint sized to accompany larger auxiliary lines. As each of the riser joints may be connected together within a riser system, depending on the number of riser joints within the riser system, this weight savings may be about 1,000,000 lbs (about 453,600 kg) or more. Accordingly, such a weight savings may enable existing handling equipment and existing systems to be used, as compared to having to increase the weight capacity of the handling equipment and systems for use with heaving riser joints and riser systems.

Although the present invention has been described with respect to specific details, it is not intended that such details should be regarded as limitations on the scope of the invention, except to the extent that they are included in the accompanying claims.

What is claimed is:

1. A subsea riser system, the riser system comprising:
a riser joint comprising a main line; and
an auxiliary line, comprising:
a pin pipe section;
a box pipe section;
an interior pipe section intermediate the pin pipe section and the box pipe section;
wherein an internal diameter of the interior pipe section is larger than an internal diameter of the pin pipe section;
wherein an external diameter of the interior pipe section is larger than an external diameter of the pin pipe section;
wherein an internal diameter of the box pipe section is larger than the internal diameter of the interior pipe section; and
wherein an external diameter of the box pipe section is larger than the external diameter of the interior pipe section.

2. The subsea riser system of claim 1, wherein the main line of the riser joint comprises a coupler at an end thereof, wherein the coupler comprises an auxiliary opening formed therethrough such that one of the pin pipe section and the box pipe section is removably received within the auxiliary opening.

3. The subsea riser system of claim 2, wherein the riser joint, the coupler, and the auxiliary opening are sized to accommodate an auxiliary line comprising a pressure capacity of about 15,000 psi (about 103.4 MPa).

4. The subsea riser system of claim 2, wherein an adjustment sleeve is adjustably connected between the one of the pin pipe section and the box pipe section of the auxiliary line and the auxiliary opening of the coupler to adjust a position of the one of the pin pipe section and the box pipe section with respect to the auxiliary opening of the coupler.

5. The subsea riser system of claim 2, wherein the coupler comprises one of a flange and a breech lock coupler.

6. The subsea riser system of claim 1, wherein the auxiliary line further comprises a tapered section intermediate the interior pipe section and the pin pipe section, and wherein an internal diameter of the tapered section is tapered between the internal diameter of the interior pipe section and the internal diameter of the pin pipe section.

7. The subsea riser system of claim 1, wherein the main line comprises an internal diameter of about 19.25 in (about 48.9 cm), wherein the internal diameter of the interior pipe section is about 4.5 in (about 11.4 cm), and wherein the internal diameter of the pin pipe section is about 3.68 in (about 9.35 cm).

8. The subsea riser system of claim 1, wherein the main line comprises a wall thickness of about 1 in (about 2.54 cm), wherein the interior pipe section comprises a wall thickness of about 1.375 in (about 3.5 cm), and wherein the pin pipe section comprises a wall thickness of about 0.985 in (about 2.51 cm).

9. The subsea riser system of claim 1, wherein the riser joint comprises a plurality of riser joints, and wherein the plurality of riser joints are connectable to each other such that the pin pipe section of the auxiliary line of one riser joint is receivable within the box pipe section of another riser joint.

10. An auxiliary line connectable to a subsea riser joint, the auxiliary line comprising:
a pin pipe section;
a box pipe section;
an interior pipe section intermediate the pin pipe section and the box pipe section;
wherein an internal diameter of the interior pipe section is larger than an internal diameter of the pin pipe section;
wherein an external diameter of the interior pipe section is larger than an external diameter of the pin pipe section;
wherein an internal diameter of the box pipe section is larger than the internal diameter of the interior pipe section; and
wherein an external diameter of the box pipe section is larger than the external diameter of the interior pipe section.

11. The auxiliary line of claim 10, wherein the auxiliary line is removably received within an auxiliary opening of a coupler of a main line, wherein the riser joint comprises the main line.

12. The auxiliary line of claim 11, wherein the riser joint, the coupler, and the auxiliary opening are sized to accommodate an auxiliary line comprising a pressure capacity of about 15,000 psi (about 103.4 MPa).

13. The auxiliary line of claim 11, wherein the coupler comprises one of a flange and a breech lock coupler.

14. The auxiliary line of claim 10, further comprising a tapered section intermediate the interior pipe section and the pin pipe section, and wherein an internal diameter of the tapered section is tapered between the internal diameter of the interior pipe section and the internal diameter of the pin pipe section.

15. The auxiliary line of claim 14, wherein an external diameter of the tapered section is tapered between the external diameter of the interior pipe section and the external diameter of the pin pipe section.

16. The auxiliary line of claim 10, wherein the internal diameter of the interior pipe section is about 4.5 in (about 11.4 cm), and wherein the internal diameter of the pin pipe section is about 3.68 in (about 9.35 cm).

17. The auxiliary line of claim 10, wherein the interior pipe section comprises a wall thickness of about 1.375 in (about 3.5 cm), and wherein the pin pipe section comprises a wall thickness of about 0.985 in (about 2.51 cm).

18. The auxiliary line of claim 10, wherein a ratio of the internal diameter of the interior pipe section with respect to the internal diameter of the pin pipe section is between about 1.1:1 and 1.3:1, and wherein a ratio of the external diameter of the interior pipe section with respect to the external diameter of the pin pipe section is between about 1.15:1 and 1.35:1.

* * * * *